US006808362B1

(12) United States Patent
Glahn et al.

(10) Patent No.: US 6,808,362 B1
(45) Date of Patent: Oct. 26, 2004

(54) ROTOR FOR A GAS TURBINE

(75) Inventors: Joern-Axel Glahn, Manchester, CT (US); Armin Heger, Kirchdorf (CH); Joerg Pross, Albbruck (DE)

(73) Assignee: Alstom Technology LTD, Baden (CH)

( * ) Notice: Subject to any disclaimer, the term of this patent is extended or adjusted under 35 U.S.C. 154(b) by 0 days.

(21) Appl. No.: 10/204,479

(22) PCT Filed: Feb. 21, 2000

(86) PCT No.: PCT/CH00/00092

§ 371 (c)(1),
(2), (4) Date: Oct. 31, 2002

(87) PCT Pub. No.: WO01/63097

PCT Pub. Date: Aug. 30, 2001

(51) Int. Cl.[7] ..... F01D 5/08
(52) U.S. Cl. ..... 415/115; 415/116
(58) Field of Search ..... 415/115, 116

(56) References Cited

U.S. PATENT DOCUMENTS 2,636,665 A * 4/1953 Lombard ..... 415/115
2,973,938 A * 3/1961 Alford ..... 416/96 R
3,844,110 A * 10/1974 Widlansky et al. ..... 415/60
4,522,562 A * 6/1985 Glowacki et al. ..... 415/116
5,144,794 A 9/1992 Kirikami et al.
5,271,711 A 12/1993 McGreehan et al.

FOREIGN PATENT DOCUMENTS

| | | |
|---|---|---|
| DE | 2633222 | 1/1978 |
| DE | 3047514 | 10/1981 |
| DE | 19617539 | 11/1997 |
| EP | 0584958 | 3/1994 |

* cited by examiner

*Primary Examiner*—Edward K. Look
*Assistant Examiner*—Igor Kershteyn
(74) *Attorney, Agent, or Firm*—Burns, Doane, Swecker & Mathis, L.L.P.

(57) ABSTRACT

A rotor for a gas turbine is disclosed. The rotor has a plurality of rotor disks arranged one behind the other on a rotor axis. The rotor extends between a compressor part and a turbine part, and has a central bore running between the compressor part and the turbine part. Fluid passages are arranged to conduct cooling air from the compressor part and direct cooling through the central bore and direct cooling air from the turbine part radially outward through the rotor. The rotor disks have fluid cavities that are connected to the central bore by having an outer diameter that is greater than the inside diameter of the central bore. The fluid cavities are subdivided into individual chambers by a plurality of radial ribs.

9 Claims, 2 Drawing Sheets

ROTOR FOR A GAS TURBINE

TECHNICAL FIELD

The present invention relates to the technical field of gas turbines. It relates to a rotor for a gas turbine, which rotor comprises a plurality of rotor disks arranged one behind the other in a rotor axis and connected, in particular welded, to one another, and which rotor extends between a compressor part and a turbine part and has a central bore running between both parts and having an inside diameter, there being first means which branch off cooling air in the compressor part and direct it radially inward through the rotor into the central bore, and there being second means which, in the turbine part, direct the cooling air from the central bore radially outward through the rotor.

Guidance of the cooling-air flow via the central bore in the rotor has been disclosed, for example, by U.S. Pat. No. 5,271,711.

PRIOR ART

Widely varying requirements are imposed on the rotors of gas turbines. In particular, the rotors are to be designed in such a way that cooling-air mass flows can be extracted at the compressor and directed with low losses through the central bore of the rotor to the (low-pressure) turbine in order to cool the moving blades there. In this case, the rotor is at the same time also to be capable of being produced by welding together from individual disks and is to be cost-effective to produce overall.

In order to keep down the flow losses, a situation must be avoided in which swirl flows can develop in the cooling-air flow. For that reason, the cooling air must be directed on its radial path to and from the central bore. Suitable bores for this in terms of production are radial bores. However, large cooling-air mass flows require large cross sections of the bores, so that the bores, in the required number and size, already converge at a diameter which is markedly above the inside diameter of the central bore.

A further possible solution is (radial) ribs which subdivide the cavities between the disks of the rotor into smaller chambers and thus prevent the swirl formation in the cooling-air mass flow. However, such ribs are expensive to produce and are highly stressed mechanically by the forces occurring at the high speeds of the rotor. In the case of welded rotors, there is also the further restriction that these rotors can only be repaired with great difficulty, i.e. welded rotors must be designed in such a way that crack formation can be ruled out.

The known solutions meet only some of the abovementioned requirements. The disks are partly designed as components of bolted rotors. This joining technique permits more degrees of freedom in the geometry of the disks, so that the ribs referred to can be realized more-easily. In addition, a bolted rotor can be repaired. In welded rotors, this is therefore not the case. However, the disks are also partly designed for smaller cooling-air mass flows. In this case, the cooling-air bores can be run almost directly up to the central bore without overlapping occurring.

A solution which equally meets all requirements is not known.

DESCRIPTION OF THE INVENTION

It is therefore the object of the invention to provide a rotor for a gas turbine which avoids the disadvantages of known rotors and in particular enables large cooling-air mass flows to be directed with low losses with at the same time high mechanical stability.

The essence of the invention consists in combining radial bores and a cavity subdivided by ribs with one another in such a way that, on the one hand, a large total cross section for the cooling air is achieved with the bores and, on the other hand, the ribs are only subjected to a comparatively moderate centrifugal force. In the outer rotor region subjected to the greatest stress by the centrifugal forces, the air is extracted through radial bores. The end of the bores is shifted in the direction of the rotor axis to such an extent that the discharge openings are at an acceptable distance from one another. The cavity into which the bores open, and into which the cooling air is then injected, is subdivided into chambers by relatively short ribs which prevent a build-up of swirl. These short ribs have the advantage that they end on a relatively small outer radius of the cavity, and thus the loading centrifugal forces are kept small.

In principle, the bores may have different diameters and be at a distance from one another which may at first be any desired distance and is selected in such a way that the requirements with regard to strength, producibility and aerodynamics are met. However, a first preferred embodiment of the rotor according to the invention is characterized in that all the first radial bores have the same bore diameter, and in that the outside diameter of the first cavity is selected in such a way that the distance between two adjacent first radial bores at the orifice to the first cavity corresponds approximately to the bore diameter. An optimized compromise between mass flow and rib stress is achieved by this dimensioning.

A further improvement in the strength of the ribs is obtained if, according to a second preferred embodiment of the invention, the first ribs converge in the center of the first cavity in a common hub.

The production becomes especially simple if, according to another preferred embodiment of the rotor according to the invention, the first cavity and the first ribs located therein are fashioned out of the first rotor disk by milling out from one side, and the first cavity is defined by an adjacent rotor disk.

Depending on the guidance of the cooling-air mass flow, the first radial bores may run in a plane perpendicular to the rotor axis or may be positioned in the axial direction. For fluidic reasons, however, it may also be advantageous if the first radial bores are positioned in the tangential direction.

BRIEF EXPLANATION OF THE FIGURES

The invention is to be explained in more detail below with reference to exemplary embodiments in connection with the drawing, in which.

WAYS OF IMPLEMENTING THE INVENTION

Figure 1:
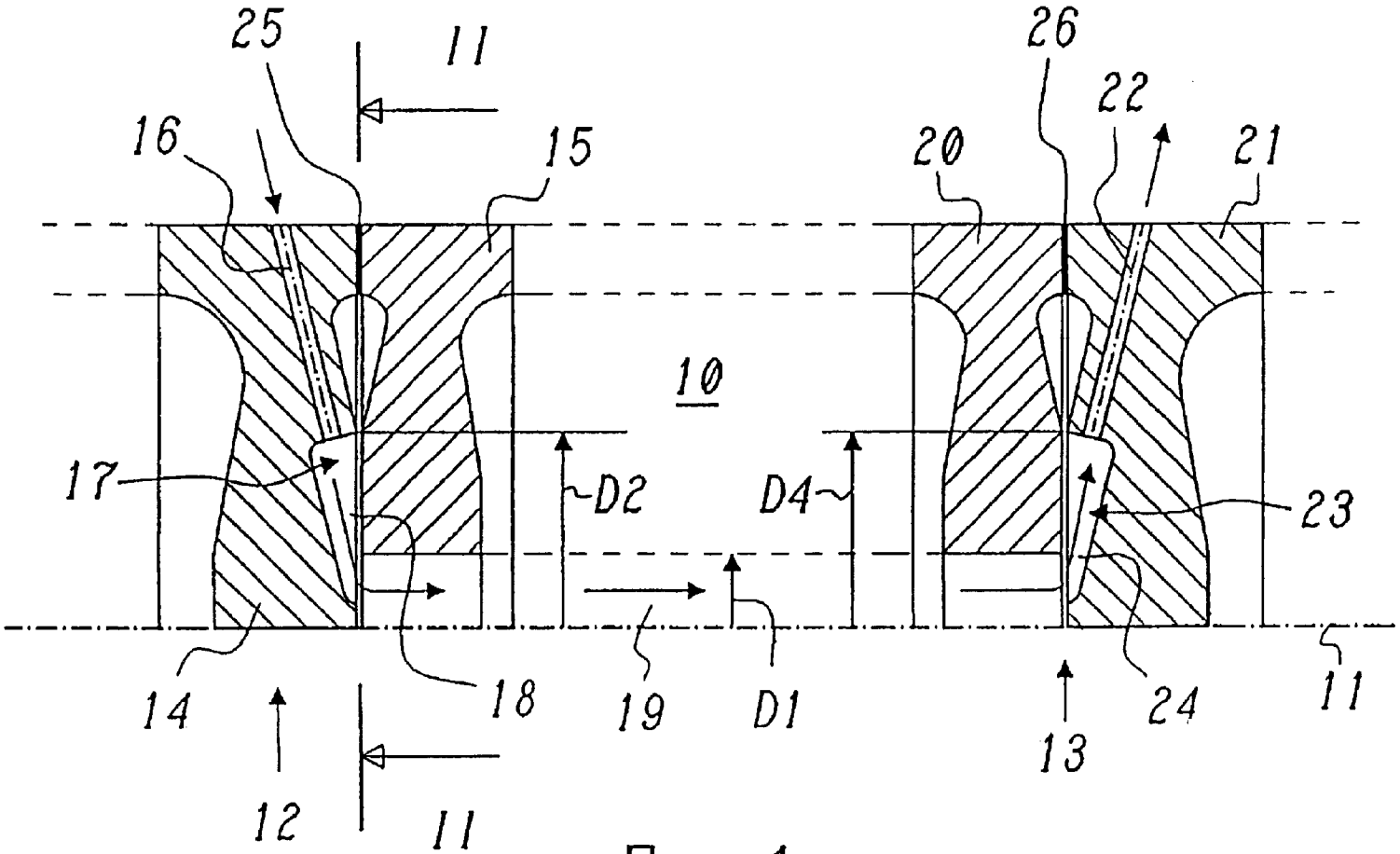
FIG. 1 shows, in longitudinal section, a section of a rotor according to a preferred exemplary embodiment of the invention.

A section of a rotor according to a preferred exemplary embodiment of the invention is shown in longitudinal section in FIG. 1. The rotor 10, which is designed to be rotationally symmetrical to the rotor axis 11, is composed of a plurality of individual rotor disks which are arranged one behind the other in the direction of the rotor axis 11 and which (in this case) are welded to one another. FIG. 1 only shows four selected rotor disks 14, 15, 20 and 21, which are connected to one another by corresponding welds 25 and 26, respectively. The (adjacent) rotor disks 14 and 15 are located in the compressor part 12 of the gas turbine belonging to the rotor 10. The (adjacent) rotor disks 20, 21 lie in the turbine part 13 of the gas turbine.

To cool the blades in the turbine part 13, cooling air is branched off in the compressor part 12 and is directed in a central bore 19 of the rotor 10 from the compressor part 12 to the turbine part 13 and is passed there into the blades (not shown in FIG. 1) located on the outside on the rotor 10 (arrows in FIG. 1). The central bore 19 has a relatively small inside diameter D1 compared with the outside diameter of the rotor 10. If the radial bores 16 which are arranged in the rotor disk 14 and which direct the branched-off cooling air through the interior of the rotor 10 to the central bore 19 were therefore to be run right up to the central bore 19, there would only be space for a few bores on the circumference of the central bore 19, so that only a limited cooling-air mass flow would be obtained.

In order to provide space for more bores (or bores having a larger bore diameter), an annular cavity 17 is arranged in the rotor disk 14, this cavity 17 having an outside diameter D2 which is markedly larger than the inside diameter D1 of the central bore 19. The radial bores 16 open into this cavity 17 (also see FIG. 2), this cavity 17 being of fluidically favorable design in cross-sectional profile. The cavity 17 extends inward so far toward the rotor axis 11 that it is connected to the central bore 19. It is preferably milled in the rotor disk 14 from one side and is defined on this side by the adjacent rotor disk 15. In this case, the distance between the adjacent rotor disks 14, 15 depends on the tolerances during the welding and on the thermal and mechanical expansions during operation. The two disks in any case must not come into contact in any operating state.

Figure 2:
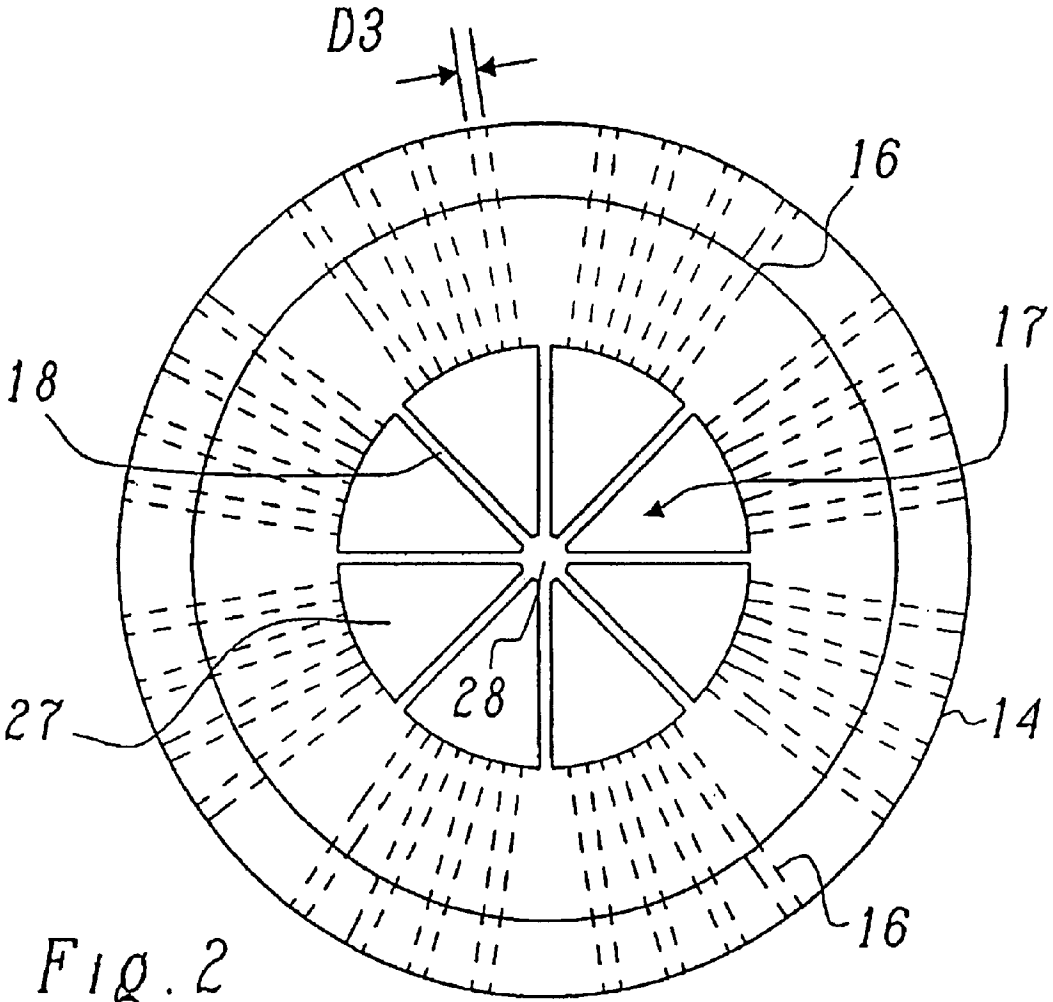
FIG. 2 shows the cross section through the rotor according to FIG. 1 along plane II—II.

The outside diameter D2 of the cavity 17 is preferably selected in such a way that the distance between two adjacent radial bores 16 at the orifice to the first cavity 17 corresponds approximately to the bore diameter D3 (FIG. 2). So that the cooling-air flow is not given any undesirable swirl when crossing the cavity 17 from the orifices of the radial bores 16 to the central bore 19, the cavity is subdivided into individual chambers 27 by radial ribs 18 (FIG. 2). The ribs 18 are left when the cavity 17 is milled out, so that a (common) hub 28 in which the ribs 18 converge is produced in the center, and the ribs 18 end at the discharge periphery of the radial bores 16. As a result, the rotor disk 14 is mechanically relieved.

In an analogous manner, the cooling air can be directed outward in the turbine part 13 from the central bore 19 through the interior of the rotor 10. To this end, corresponding radial bores 22 are provided in the rotor disk 21, these bores 22 starting from an annular cavity 23 which is subdivided by ribs 24 and is connected to the central bore 19. Here, the same considerations as in the case of the cavity 17 apply to the outside diameter D4 of the cavity 23.

Within the scope of the invention, the rotor 1.0, in accordance with the requirements, may be produced from rough-forged rotor disks with a large variation in the number of bores and ribs. At the same time, the bores 16, 22 may be positioned not only purely radially but also in both a tangential and—as shown in FIG. 1—axial direction.

On the whole, a construction which has the following features and advantages is obtained with the invention:

the radial bores, which are simple to produce, are as long as possible;

the ribs, which are unfavorable from the strength and production point of view, are as short as possible;

the large mass flows required can be realized;

the construction can be welded;

the production cost is kept within limits.

List of Designations

10 Rotor (gas turbine)
11 Rotor axis
12 Compressor part
13 Turbine part
14, 15 Rotor disk
16, 22 Radial bore
17, 23 Cavity
18, 24 Rib
19 Central bore
20, 21 Rotor disk
25, 26 Weld
27 Chamber
28 Hub
D1 Inside diameter (central bore)
D2, D4 Outside diameter (cavity)
D3 bore Diameter (radial bore)

What is claimed is:

1. A rotor for a gas turbine, which rotor comprises a plurality of rotor disks arranged one behind the other in a rotor axis and connected to one another, and which rotor extends between a compressor part and a turbine part and has a central bore running between said compressor part and said turbine part and having an inside diameter, there being first passage means branching off cooling air in the compressor part and directing it radially inward through the rotor into the central bore, and second passage means which, in the turbine part, for direct the cooling air from the central bore radially outward through the rotor, wherein the first passage means comprise a plurality of first radial bores, which first radial bores run from the outside to the inside through a first rotor disk and open into a first annular cavity arranged in this first rotor disk concentrically to the rotor axis, said first cavity is connected to the central bore, in that the said first cavity has an outside diameter which is greater than the inside diameter of the central bore, and in that the first cavity is subdivided into individual chambers by a plurality of radially arranged first ribs, and wherein all the first radial bores have the same bore diameter, and the outside diameter of the first cavity is selected in such a way that the distance between two adjacent first radial bores at the orifice to the first cavity corresponds approximately to the bore diameter.

2. The rotor as claimed in claim 1, wherein the first ribs converge in the center of the first cavity in a common hub.

3. The rotor as claimed in claim 1, wherein the first cavity and the first ribs located therein are fashioned out of the first rotor disk by milling out from one side, and in that the first cavity is defined by an adjacent rotor disk.

4. The rotor as claimed in claim 1, wherein the first radial bores extend in a plane perpendicular to the rotor axis.

5. The rotor as claimed in claim 1, wherein the first radial bores are positioned in the axial direction.

6. The rotor as claimed in claim 1, wherein the first radial bores are positioned in the tangential direction.

7. The rotor as claimed in claim 1, wherein the second means comprise a plurality of second radial bores, which second radial bores run from the inside to the outside through a second rotor disk and are connected to the central bore.

8. The rotor as claimed in claim 7, wherein the second radial bores start from a second annular cavity arranged in the second rotor disk concentrically to the rotor axis, in that the second cavity is connected to the central bore, in that the second cavity has an outside diameter which is greater than the inside diameter of the central bore, and in that the second cavity is subdivided into individual chambers by a plurality of radially arranged second ribs.

9. The rotor as claimed in claim 1, wherein said rotor disks are welded to one another.

* * * * *